United States Patent [19]

Sullivan

[11] Patent Number: 5,052,334

[45] Date of Patent: Oct. 1, 1991

[54] COATING APPLICATOR FOR MOVING FIBERS

[75] Inventor: William Sullivan, Gillete, N.J.

[73] Assignee: Hoechst Celanese Corp., Somerville, N.J.

[21] Appl. No.: 486,043

[22] Filed: Feb. 27, 1990

[51] Int. Cl.[5] ..... B05C 1/08

[52] U.S. Cl. ..... 118/234; 118/244; 118/252; 118/259; 118/DIG. 20

[58] Field of Search ..... 118/234, 244, 252, 259, 118/DIG. 20, DIG. 22; 156/425, 429

[56] References Cited

U.S. PATENT DOCUMENTS

| | | | |
|---|---|---|---|
| 3,498,262 | 3/1970 | Hill et al. | 118/234 |
| 3,827,397 | 8/1974 | Hebberling et al. | 118/234 |
| 4,517,916 | 5/1985 | Barch et al. | 118/234 |

FOREIGN PATENT DOCUMENTS

| | | | |
|---|---|---|---|
| 663471 | 5/1965 | France | 118/259 |

*Primary Examiner*—Michael Wityshyn

*Attorney, Agent, or Firm*—Joseph M. Mazzarese

[57] ABSTRACT

A device for applying a coating to moving fibers is shown comprised of a cylindrical applicator rotating about its axis, a support frame for supporting the cylindrical applicator wherein said support frame contains a cylindrical opening running through the support frame for supporting the cylindrical applicator, a slot with an opening running from the slot to the cylindrical opening, an internal passageway in the support frame and a tubular connecting piece which fits partially in the internal passageway of the support frame for delivering the coating to the surface of the cylindrical applicator. It is critical that the diameter of the cylindrical applicator be only slightly less than the diameter of the cylindrical opening running through the support frame, thus restricting the amount of liquid coating that can be applied to the moving fiber. By placing the tubular connecting piece directly adjacent to the cylindrical applicator, no pool of coating is created. Thus, the amount of the fluid that is applied to the cylindrical applicator can be strictly controlled.

9 Claims, 2 Drawing Sheets

COATING APPLICATOR FOR MOVING FIBERS

BACKGROUND OF INVENTION

1. Field of Invention

This invention relates to a device for applying coating to fibers. In particular, this invention relates to a unique device for applying a controlled amount of a liquid coating to a moving fiber or fibers.

2. Prior Art

In the manufacturing of textile yarns, polymer filaments and other types of fibers, various chemical treatments are frequently applied to the fibers. (Fiber, as used throughout this specification and in the appended claims is intended to include all types of strands, threads, yarns, filaments, fibers, bundles of filaments, ribbons, bands, extruded wire and the like.)

At various stages in the processing of fibers, whether of synthetic or natural origin, they frequently are coated with a liquid coating. Except for dipping of the thread itself, which is often neither practical nor economical, the simplest method of coating application is by means of passing the fiber across some form of applicator onto which the liquid coating has been placed.

Liquid coatings are conventionally applied to threads using pads, rollers, sprays, belt applicators or other forms of contact applicators. All of these various contact-type applicators are positioned in receptacles of various shapes and dimensions. These receptacles contain the liquid coating to be applied to the fiber as well as the contact applicator means. For example, U.S. Pat. No. 1,621,303, Altemus discloses a yarn oiling device where yarn passes across a rotating roller wherein the roller is immersed in a receptacle for the oil.

U.S. Pat. No. 2,025,079, Whitehead discloses a similar apparatus for applying a liquid to a textile material wherein a disk having an edge is rotated in a receptacle containing the coating material. The thread runs across the disk perpendicular to the flat surface of the disk.

Various modifications to these conventional dip bath coating procedures have been designed for various coating applications relating to the coating or dying of fibers. For example, U.S. Pat. No. 3,492,840 Korsch discloses a double roller method for dyeing one surface of a fiber wherein one of the rollers is dipped in a dip bath while the second roller holds the fiber against the first roller.

U.S. Pat. No. 3,507,250 Dew, Jr. discloses a more complicated method for applying a coating to a fiber using the same dip bath roller procedure. In this patent a rotating disk is placed in a typical dip bath. As the disk rotates out of the dip bath a scrapper removes a portion of the coating from the disk and passes it down the surface of the scraper, preferably in troughs. At the edge of the scraper, the coating touches the surface of an applicator bar which may or may not rotate. Fibers pass over this applicator bar and are thus coated with the coating.

Certain improvements have been made in this rotating disk procedure for coating fibers. For example in U.S. Pat. No. 4,192,252, Paul and U.S. Pat. No. 4,548,840, States et. al. each of the rotating disks has an edge or a doctor blade for restricting the amount of coating which flows onto the surface of the rotating disk.

Other conventional apparatus for applying a liquid coating to the surface of a fiber or fibers using a rotating disk in a trough containing a liquid coating are disclosed in, for example, U.S. Pat. No. 4,121,901, Bourrain et. al., U.S. Pat. No. 3,993,805, Roberts, U.S. Pat. No. 3,811,834, Schwemmer et. al., U.S. Pat. No. 4,222,344, Parbhoo and U.S. Pat. No. 4,561,377, Youngkeit.

A refinement to this conventional rotating disk method for the application of a liquid coating to a fiber uses a belt-type applicator wherein the liquid is applied to the belt either by passing it through a trough or by pouring it onto the surface of the belt. See, for example, U.S. Pat. No. 2,873,718, Brautigam and U.S. Pat. No. 2,968,278, Wolfe.

Another method for applying a liquid coating to the surface of a fiber uses a double rotating disk wherein the first disk is placed within a trough and as it rotates it applies the liquid coating to a second disk. The second disk may have a doctor blade associated with it or other such devices for limiting the amount of liquid coating that is applied to the surface of the second disk. See, for example, U.S. Pat. No. 3,852,090, Leonard et. al. and U.S. Pat. No. 4,538,541, Zimmer.

A more sophisticated two cylinder delivering system for a liquid coating is disclosed in U.S. Pat. No. 4,517,916, Barch et. al. In the '916 patent a tubular hollow delivering system, (13) is supplied with a liquid coating for fibers. Since the coating is under pressure, it is extruded through a longitudinal opening (16) onto the surface of an applicator means (12), which is another cylindrical tube. As the applicator rotates, the liquid coating is extruded onto the surface of the applicator and then onto the surface of fibers which run over the surface of the applicator.

All of these systems for coating fibers generally contain an applicator rotating within a reservoir. After the applicator leaves the reservoir, the surface of the applicator contacts a moving fiber to coat it with a liquid coating. While many of these systems have been successful in the coating of fibers, they still have certain deficiencies. For example, the amount of the liquid coating to be applied to the fiber is not well controlled. This problem frequently results not only in too little liquid coating being applied to the fiber but at times too much being applied. In addition, some of the modern coating systems are quite complicated and expensive to manufacture. Thus, an easy, inexpensive method for applying a liquid coating to moving fiber is still needed in the industry.

Therefore it is an object of this invention to provide an easy, inexpensive device for the application of a liquid coating to a moving fiber.

It is another object of this invention to provide a device for the application of a liquid coating to a moving fiber wherein the applicator roller is not immersed in a reservoir.

It is a still further object of this invention to provide a device for applying a liquid coating to a moving fiber wherein the amount of the coating applied to the moving fiber can be carefully regulated.

These and other objects and features of the present invention will become apparent to those skilled in the art from a consideration of the following detailed description, drawings and claims. The description along with accompanying drawings provide a selective example of construction of the device to illustrate the invention.

SUMMARY OF INVENTION

In accordance with the present invention there is provided a coating applicator device for applying a liquid coating to a fiber comprising:

(a) a cylindrical applicator rotating about its axis, attached to a means for rotating the cylindrical applicator;

(b) a support frame means for supporting the cylindrical applicator wherein said support frame means contains a cylindrical opening running through the support frame means for supporting the cylindrical applicator, a slot containing a slot opening running from the slot to the cylindrical opening and an internal passageway; and (c) a tubular delivery means which fits partially within the internal passageway of the support frame means.

This coating application provides a reliable method for coating a moving fiber, or group of fibers, without immersing the cylindrical applicator roller in a reservoir. By the arrangement of the applicator roller within the support frame, the amount of coating that is applied to the fiber can be closely controlled. Because of its unique construction, this device provides an efficient, inexpensive method for coating fibers.

BRIEF DESCRIPTION OF THE DRAWINGS

The invention will now be described with reference to the accompanying drawings in which.

DETAILED DESCRIPTION OF THE PREFERRED EMBODIMENT

Figure 1:
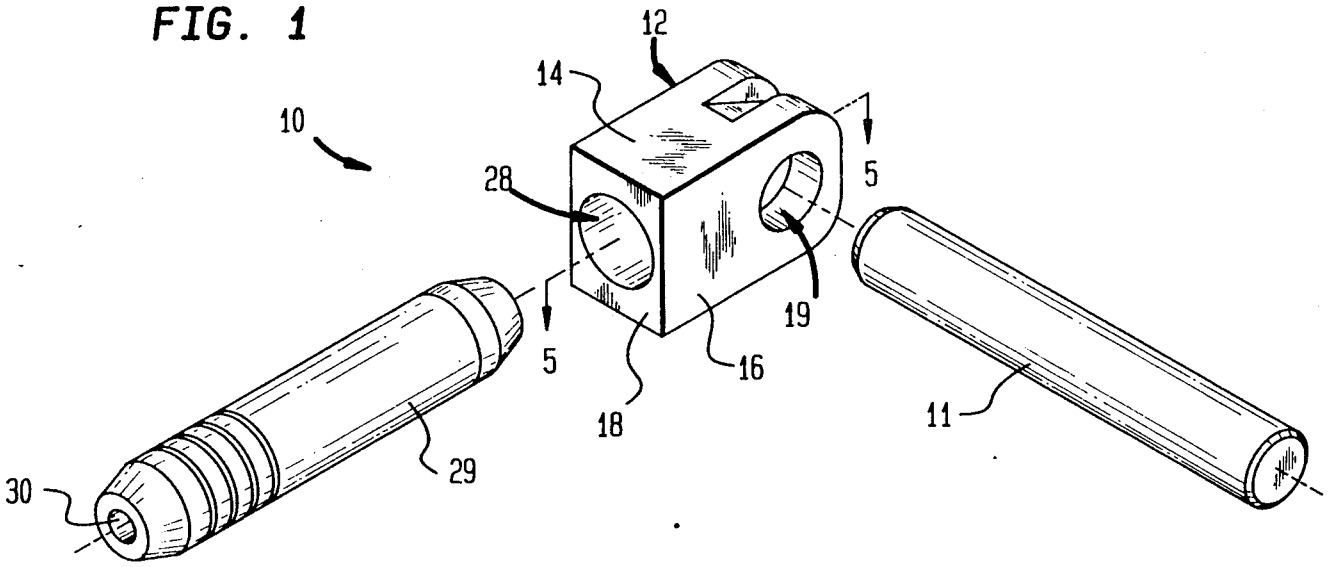
FIG. 1 is a exploded view of the device for applying a liquid coating to a moving fiber.

Although the invention is adaptable to a wide variety of uses, it is shown in the drawings for purpose of illustration as embodied in a device (10) for applying a coating to a moving fiber comprised of a rotating cylindrical applicator (11) rotating about its axis, a support frame (12) for supporting the cylindrical applicator and a tubular delivery system for delivering the coating to the cylindrical applicator. See FIG. 1. This invention is useful for the coating of fibers made from various types of materials both naturally occurring, such as cotton or wool, and man-made, such as nylon, polyester, polypropylene, polyvinyl chloride, acrylonitrile and other such materials.

The applicator is generally cylindrical in shape and can be hollow or solid. The only restriction on the size of applicator is that its diameter should be sufficient to transfer a liquid coating to the fiber or fibers that contact the surface of the applicator. The diameter of the cylinder can be any diameter which will efficiently coat a fiber and preferably will be about ¼ inch to about 1 inch. This provides a sufficient area of contact for the moving fibers which contact the applicator.

The cylindrical applicator (10) is attached to any conventional means for rotating the applicator. The cylindrical applicator can be rotated by a belt driven means of rotation or by attachment to a conventional motor as is well known in the industry. (no shown) The speed of rotation will depend on the amount of the coating to be applied to the fibers and the speed of the fibers as they pass over the applicator. The means for rotating the roller should be sufficient to generate the necessary speed for complete coating of the fibers.

Figure 2:
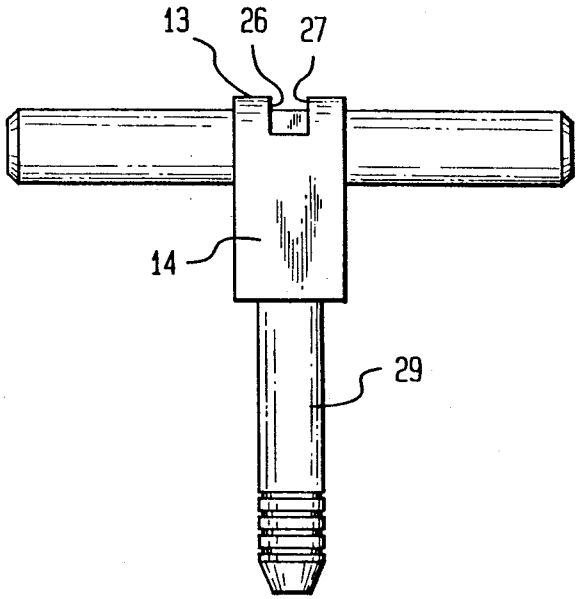
FIG. 2 is a side view of the device.
Figure 3:
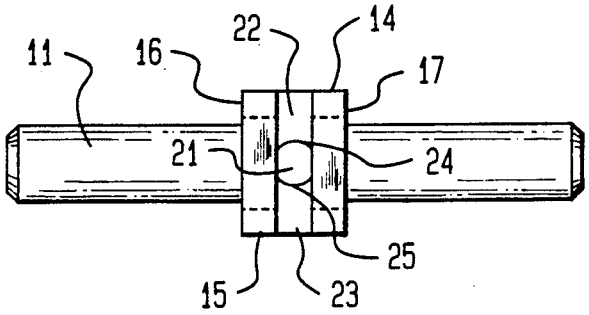
FIG. 3 is a top view of the device.
Figure 4:
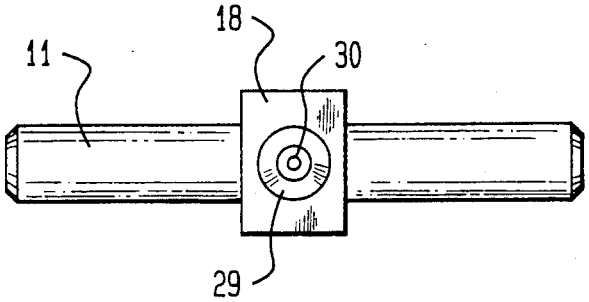
FIG. 4 is a bottom view of the device.

The support frame (12) for supporting the rotating cylindrical applicator can be of any shape or size sufficient to accomplish the desired support function. In a preferred embodiment, the support is a generally rectangular cube containing a top (13), front (14), back (15), two sides (16, 17), a bottom (18) and a cylindrical applicator opening (19) running through both sides of the cube through which the cylindrical applicator (11) passes. See FIGS. 2, 3 and 4. Although it is, of course, understood that the cylindrical applicator must rotate freely within the frame, it is important to the invention that the diameter of this cylindrical applicator opening (19) be only slightly larger than the diameter of the cylindrical rotating applicator (11). In a preferred embodiment the space between the cylindrical rotating applicator and the cylindrical opening running through the support frame means is less than about 0.1 inch.

In the top of the support frame is a coating applicator slot (20). See FIGS. 2 and 3. The slot (20) is of sufficient depth to create a coating passage opening (21) between the cylindrical applicator opening (19) and the coating applicator slot (20). This coating passage opening (21) is of any size sufficient to allow an adequate amount of liquid coating to pass through the coating passage opening onto fibers running through the slot. In a preferred embodiment, the coating passage opening is from about ¼ to about ¾ the diameter of the cylindrical applicator opening (19).

The coating applicator slot (20) has upper and lower sloped edges (22, 23). See FIG. 3. These edges are slanted away from the surface of the support frame to allow the fibers to be held securely within the slot. Besides supporting the fibers that pass through the slot of the coating applicator, the inside lips (24, 25) of these edges operate as scrapers or blades to restrict the amount of coating that can remain on the surface of the cylindrical applicator as it rotates through the cylindrical applicator opening. See FIG. 3. In a preferred embodiment depending on the manner of rotation one lip limits the amount of coating that can be placed on the fiber while the other lip removes excess coating remaining after the fibers are coated.

As the fiber passes over the rotating applicator, it is constrained by the sides of the slot (26, 27). Thus, the slot must be cf sufficient depth in the surface of the support frame means to create a passageway for the fibers. In a preferred embodiment the depth of the slot is at least about 0.125 inches. The width of the slot is not critical but should be at least twice as wide as the fibers which pass through the slot.

The support frame can be made of any non-corrosive material such as graphite, stainless steel, aluminum or a heavy duty thermoset polymeric or ceramic material. In a preferred embodiment the support frame is produced from a heavy duty ceramic.

Passing through the bottom (18) into the inside of the support frame is an internal passageway (28) which supports a tubular connecting piece (29) of the tubular delivery system for delivering the coating to the cylindrical applicator. The size and shape of this internal passageway (28) are not critical and are dependent only upon the size and shape of the tubular connecting piece (29). At the internal end of the internal passageway, the internal passageway meets the cylindrical applicator opening (19) which runs generally perpendicular to the internal passageway (28).

Figure 5:
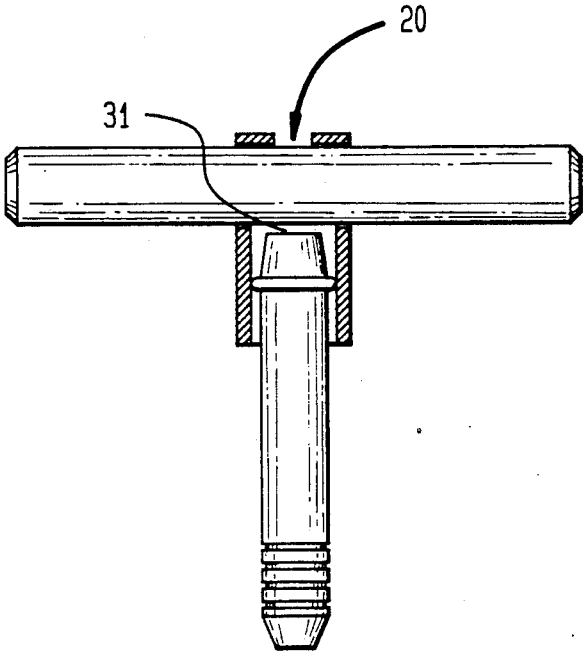
FIG. 5 is a side cut away view of the device.

The internal passageway supports the tubular connecting piece (29) which delivers coating to the applicator. See FIG. 5. The tubular connecting piece runs from outside of the coating applicator to the cylindrical applicator and contains an inner passageway (30) running its entire length. The tubular connecting piece can be any type of conventional delivery tube which fits within the internal passageway of the coating applicator.

The internal end (31) of the tubular connecting piece should be placed directly adjacent to the cylindrical applicator without restricting the rotation of the applicator so that the coating when flowing through the inner passageway (30) in the tubular connecting piece (29) immediately contacts the rotating applicator (11). It is critical that the internal end (31) of the tubular connecting piece be directly adjacent to the cylindrical applicator and that a minimum amount of space be available for the coating to flow within the internal passageway. See FIG. 5. The distance between the end of the cylindrical applicator and the tubular delivery device should be less than about 0.1 inch. This restriction on the amount of distance between the internal end of the tubular connecting piece and the cylindrical applicator results in good control of the amount of coating which is applied to the fibers and limits the imprecise coating of fibers which has been a problem in the industry.

The tubular connecting piece (29) can be manufactured from any conventional materials and in a preferred embodiment, the tubular connecting piece is manufactured from stainless steel, graphite, heavy duty ceramic, aluminum or other such material.

Attached to the outer end of the tubular connecting piece will be a conventional conduit (not shown) to deliver the coating to the tubular connecting piece. The coating can pass through the conduit under pressure from a fluid control device of conventional construction that would provide force to move the coating through the conduit. If the pump does not provide sufficient control, a metering device can be attached in the conduit to meter out the appropriate coating.

While this disclosure contemplates the use of a single coating application system, it would be obvious to attach several tubular delivery systems to an elongated support frame with a number of slots for applying coating to a number of fibers at the same time. It would also be obvious to attach a number of support frame means to an elongated cylindrical applicator to apply coating to a number of fibers at the same time.

In operation, a liquid coating is passed through the conventional conduit under pressure to the tubular connecting piece (29). The coating flows through the inner passageway (30) of the tubular connecting piece to the internal end (31) of that tubular connecting piece. The cylindrical applicator (11) rotates either in a clockwise or counterclockwise rotation within the cylindrical applicator opening (19) in the support frame (12) for supporting the cylindrical applicator. As the cylindrical applicator rotates, it carries the coating forward until it encounters the coating applicator slot (20) in the support frame. In the center of this slot is the coating applicator opening (21) exposing the fibers to the surface of the rotating applicator. Moving fibers touching the cylindrical rotating applicator are then covered by the coating. The amount of the coating on the fibers is limited by the action of the lips (24, 25) of the upper (24) and lower (25) edges of the slot.

I claim:

1. A device for applying a liquid coating to a moving fiber comprising:
   a) a cylindrical applicator and a means attached to said applicator for rotating said applicator;
   b) a support frame for supporting said cylindrical applicator, said support frame having a cylindrical opening running therethrough for closely receiving and supporting said applicator, a slot for receiving the fiber, a coating passage opening running from said slot to said cylindrical opening, and an internal passageway connected to said cylindrical opening; and,
   c) a tubular delivery means which fits partially within said internal passageway of said support frame, said delivery means having an internal passageway through which the liquid coating may be delivered to said applicator, said delivery means being directly adjacent to and cooperating with said applicator so that a film of the coating may be applied to said applicator at a controlled rate.

2. The device for applying a coating to a moving fiber of claim 1 wherein the slot has upper and lower edges which are slanted.

3. The device for applying a coating to a moving fiber of claim 1 wherein the diameter of the cylindrical applicator is less than 0.1 inch smaller than the diameter of the cylindrical opening running through the support frame.

4. The device for applying a coating to a moving fiber of claim 1 wherein the support frame is produced from a heavy duty ceramic.

5. The device for applying a coating to a moving fiber of claim 1 wherein the tubular delivery means contains a tubular connecting piece with an internal end containing an inner passageway which passes completely through the tubular connecting piece.

6. The device for applying a coating to a moving fiber of claim 5 wherein the internal end of the tubular connecting piece is located less than about 0.1 inch from the cylindrical applicator.

7. The device for applying a coating to a moving thread of claim 1 wherein the support frame is a rectangular cube containing a top, front, back, two sides, a bottom and said cylindrical opening running through both sides of the cube.

8. The device for applying a coating to a moving thread of claim 1 wherein the depth of the slot is at least about 0.125 inch.

9. A device for applying a liquid coating to a moving fiber comprising:
   a) a cylindrical applicator and a means attached to said applicator for rotating said applicator;
   b) a support frame for supporting said cylindrical applicator wherein said support frame contains a top, bottom, front, back, two sides, a cylindrical opening for receiving and supporting said cylindrical applicator which extends through the two sides of said support frame and has a diameter larger than that of said applicator by less than about 0.1 inch, a slot in the top for receiving the fiber, a coating passage connecting said slot to said cylindrical opening and an internal passageway extending from said cylindrical opening through the bottom; and
   c) a tubular delivery means containing a tubular connecting piece which fits partially within said internal passageway of said support frame and which is less than about 0.1 inch from said cylindrical applicator for delivery of the coating to said cylindrical applicator.

* * * * *